US011813771B2

(12) United States Patent
Igo et al.

(10) Patent No.: US 11,813,771 B2
(45) Date of Patent: Nov. 14, 2023

(54) PORTABLE CEMENT MIXING APPARATUS WITH PRECISION CONTROLS

(71) Applicant: STONE TABLE, LLC, Oklahoma City, OK (US)

(72) Inventors: John Igo, Edmond, OK (US); Leland Graves, Nichols Hills, OK (US); Wesley Zimmerman, Norman, OK (US)

(73) Assignee: Stone Table, LLC, Oklahoma City, OK (US)

( * ) Notice: Subject to any disclaimer, the term of this patent is extended or adjusted under 35 U.S.C. 154(b) by 780 days.

(21) Appl. No.: 16/879,651

(22) Filed: May 20, 2020

(65) Prior Publication Data

US 2020/0276731 A1 Sep. 3, 2020

Related U.S. Application Data

(63) Continuation of application No. 14/517,085, filed on Oct. 17, 2014, now Pat. No. 10,695,950.

(51) Int. Cl.

| | |
|---|---|
| ***B28C 7/04*** | (2006.01) |
| ***B28C 7/02*** | (2006.01) |
| ***B28C 9/04*** | (2006.01) |

(52) U.S. Cl.

CPC ..... *B28C 7/02* (2013.01); *B28C 7/0422* (2013.01); *B28C 7/0436* (2013.01); *B28C 9/0454* (2013.01)

(58) Field of Classification Search

CPC ..... B28C 7/0436; B01F 35/2117

USPC ..... 366/18, 34, 40, 64, 66

See application file for complete search history.

(56) References Cited

U.S. PATENT DOCUMENTS

| | | | | |
|---|---|---|---|---|
| 808,599 | A | 12/1905 | Crichfield | |
| 4,325,641 | A | 4/1982 | Babus et al. | |
| 5,121,989 | A | 6/1992 | Horton et al. | |
| 5,730,523 | A | 3/1998 | Flood | |
| 5,908,240 | A | 6/1999 | Hood | |
| 6,186,654 | B1 | 2/2001 | Gunteret, Jr. et al. | |
| 8,177,411 | B2 * | 5/2012 | Borgstadt | G05D 21/02 366/18 |
| 10,695,950 | B2 * | 6/2020 | Igo | B28C 7/0422 |
| 2002/0001255 | A1 | 1/2002 | Flood et al. | |
| 2003/0002384 | A1 | 1/2003 | Flood | |
| 2004/0218462 | A1 | 11/2004 | Stephens | |
| 2006/0093536 | A1 * | 5/2006 | Selby | B01F 27/70 422/224 |
| 2008/0273415 | A1 | 11/2008 | Thornton et al. | |

(Continued)

*Primary Examiner* — David L Sorkin

(74) *Attorney, Agent, or Firm* — McAfee & Taft

(57) ABSTRACT

A quality assurance system for mixing a slurry comprising at least water or other liquid and at least one flowable wet or dry mass, such as cement, sand or other suitable component, has computerized control over the loading of ingredients and has an accurate and broadly variable speed control of the loading of the ingredients. The mixing chamber has scales that provide a signal indicating the current weight of an ingredient in the mixing chamber. The broadly variable control of the loading rate of the ingredients allows more accurate control of the final weight of each ingredient added. A damping period allows system vibrations to dissipate, allowing highly accurate weights to be measured. Accurate records of the addition of each ingredient are maintained using the internal computer that controls the invention.

21 Claims, 8 Drawing Sheets

(56) References Cited

U.S. PATENT DOCUMENTS

| | | | | |
|---|---|---|---|---|
| 2008/0310247 | A1 | 12/2008 | Basaraba | |
| 2011/0305101 | A1* | 12/2011 | Brouillette | B01F 25/50 366/34 |
| 2014/0216302 | A1* | 8/2014 | Ober | C09K 8/46 366/18 |
| 2014/0355372 | A1 | 12/2014 | Black et al. | |

* cited by examiner

PORTABLE CEMENT MIXING APPARATUS WITH PRECISION CONTROLS

CROSS-REFERENCE TO RELATED APPLICATION

This application is a continuation of U.S. application Ser. No. 14/517,085 filed Oct. 17, 2014, now allowed, which is incorporated by reference.

BACKGROUND OF THE INVENTION

The present invention is directed to a transportable mixing apparatus for cementitious products transported to and operated on location at a construction site and where accurate control as well as precise qualities, measurements, and performance characteristics of the production processes and of the final cementitious product are required or desired. The present invention is further directed to the described transportable mixing apparatus capable of providing and remotely transmitting a permanent record of all significant parameters of each mixed batch of cementitious product to an off-site location to provide quality assurance. Data recorded during production operations further allow accurate identification of manpower needs of projects and allow owners/operators at job sites to record, control, predict and manage production costs and manpower needs.

BRIEF DISCUSSION OF THE RELATED ART

Cementitious and other slurry products come in various forms, such as gypsum, cement or lime products and are used in many areas of construction and building, including, without limitation, floor underlayments and other structural and non-structural elements in buildings. For example, gypsum cement underlayments have utility in, among other things, leveling a surface on which flooring products (such as carpet or tile) are to be installed, injecting a fire retardant subfloor, or providing a substrate of sufficient hardness to sustain the applicable surface flooring products or other intended use.

Every cementitious product requires exacting measurements and specific ratios of the required ingredients to produce the desired physical characteristics. For example, tile, vinyl planks, and carpet flooring that are laid upon gypsum underlayment require very different and distinct strengths and self-leveling properties of the gypsum or other cement underlayments. Likewise, building codes and architectural plans may require various underlayment strengths and self-leveling properties. These different and distinct physical properties of cementitious products are produced only through precisely measuring and mixing exact ratios of the particular final product's ingredients. To the extent that these exacting ratios are not mixed into a specific slurry, there is an immediate and irreparable harm. In terms of product quality, the finished product will not meet required performance standards. The economic impact is incurred by the owner and user of the product. For example, an insufficient floor underlayment will begin to crumble and will cause not only an aesthetic issue, but an inability to sustain the intended use of the floor (such as foot traffic or heavy loads on rollers). The only way to repair the floor is to (i) displace the user of the floor, (ii) demolish the floor product, (iii) demolish the failing underlayment, (iv) and reinstall the underlayment and floor product. These costs are high and create a tension between the user, owner, installer, and underlayment manufacturer as they all attempt to place the blame and costs on one of the others. This tension is exacerbated by the fact that there is no current method to test floor underlayments for quality and strength once it has been poured and cured.

Cementitious products are formed by mixing two or more ingredients to form slurry that is poured and leveled, as needed, while wet and before hardening. Gypsum underlayment is formed by mixing water, a gypsum cement mix, and sand in the correct proportions to form slurry.

For example, and based on the required characteristics of the final product as well as conditions at the site, a certain amount of gypsum cement mix is mixed into a precise amount of water. Typically, an aggregate, commonly referred to as a "filler" in practice and elsewhere herein, is then added (usually fine grain or coarse grain sand) and mixed into these ingredients for a suitable time period. The resulting slurry is then poured, leveled, and left to dry or harden wherever desired.

It is necessary to have on-site mixing of certain cementitious products because (as opposed to concrete) once mixing is complete, these certain cementitious slurries' useful lives are short. For example, gypsum underlayment remains a workable slurry for less than 45 minutes.

While in theory there should be little difference in the ability of a human operator to control quality between off-site and on-site locations, the realities of human operators at active job sites make it extremely difficult to accomplish accurate measurement of the mixing ingredients. Trying to take precise measurements of bulk products at large scales at an active and fast-moving job site can produce poor results. While precise measurement can be obtained, they come at the cost of speed. Using current technologies, accurate measurements are prohibitively expensive. Conversely, cost effective measurements are unreliable. On-site mixers are operated using high powered engines, which produce systemic vibrations. To transport the mixing apparatus to the site requires the use of a trailer or similar mobile means. The combination of engines and trailer impose significant vibrational and other accuracy-defeating problems in the equipment.

As a result, in known art in the field such as U.S. Pat. No. 5,730,523 (the "'523 patent"), the invention therein is directed to transportability, especially in adverse weather conditions. Although the invention of the '523 patent includes basic features of a portable cement mixing apparatus (i.e. ingredient storage bins, delivery means, mixing means, scales and computer controls), the resulting invention allows in practice only "a" slurry to be produced, not "the" slurry required in a given application. Certainly, in practice there is a theoretical possibility that circumstances will allow a specific grade and quality of slurry to be made; however, vibration, human error and the reality of entropy indicate wholly against it. Instead, operators can provide assurances only that apparatus in use on site currently produced a slurry within wide error bars or incur significant costs to ensure constant and time-consuming testing measurements.

In a similar fashion, US 2004/0218462 (the "'462 publication") describes a proposed method of testing the slump of a slurry to determine product quality. If the slump is not accurate, a refinement to the slurry is made. Slump, however, is not a reliable test of a final product's strength or composition. For example, depending on the quality, size, and dampness of the filler used (such as sand), an operator can have two batches with the exact same slump that produce significantly varied composition and, therefore, final strength determined by multiple factors—meaning that a slurry of a known slump still will have a generally unknown composition. In effect, the '462 publication performs a one variable test of a two (or three) variable problem. It is not possible for the invention of the '462 publication to identify substantive issues with the slump where it cannot look. As a result, the slurry as poured will have unknown properties.

By way of metaphor, one might envision a theoretic device for 3-D printing a human organ. If the operator merely requires the 3-D printer to print "an" organ using "muscle" cells, it is not likely to print "the" organ necessary for transplant. By the same token, whereas many mixers of cementitious slurries are capable of mixing slurries within wide error bars, the types of mixers capable of mixing slurries within narrow and controlled limits and under normal operational requirements and time limits are either very limited or nonexistent. They operate either within the realm of guesswork or they operate prohibitively inefficiently.

The current, inaccurate on-site human operator practices and the necessity of precision measurements have created a widespread problem in the construction industry, especially when there is an allegation of defective installation. With current technology, a defective installation claim essentially becomes a mere war of words with no strong evidence to support either party's claims because (i) the installer cannot produce reliable evidence of proper mixing ratios throughout the entire project and (ii) there is no approved method of testing the strength and characteristics of a cementitious product once it has been installed and dried (i.e. core samples do not reproduce a true example of the installed product's strength). Likewise, there is currently no effective means for both accurately measuring the ingredients in a batch of a cementitious product while it is prepared and then recording that information for later use. Without accurate recordation of the ingredients and other production parameters of the slurry batches that were installed, the quality of the as-poured cementitious product cannot be reliably determined. Thus, there is no effective method for the operator to prove, either concurrently or subsequently to preparation, that each and every batch of cementitious product was properly mixed according to the manufacturer's or customer's specifications.

There is a need for a device capable of mixing ingredients for a cementitious product to produce the slurry on-site for immediate use. There is a further need for the same device to control the accurate measurement and rate of input of each individual ingredient during the mixing process regardless of operational conditions or operator error. There is a further need to take the control of the measuring and recording of the ingredients for a cementitious product away from the on-site human operator and instead ensure these activities are performed automatically and reliably, as well as record management metrics that can be measured from the data, such as productivity and operating hours. Further still, there is a need to have these precise amounts of each ingredient to be made known, recorded, and remotely transmitted to an off-site database for quality management, third-party investigation (such as by the manufacturer or building owner), and future assurance of proper ratios and mixing. The described apparatus meets these needs.

SUMMARY OF THE INVENTION

An apparatus for forming a slurry comprising at least one water or other liquid ingredient and at least one, although typically two, flowable, pourable or otherwise conveyable particulate mass or masses, generally one comprising a binding material and one comprising a filler or aggregate material, uses a computer controlled operating system, software, as well as motors and/or valves suitable to deliver a highly accurate amount of each ingredient one at a time into the mixing chamber. For purposes of this specification, the term "slurry" is used for any slurry or slurry-like product, which can be described as any temporary fluid material that requires the mixing of dry and wet ingredients that can then be pumped through a hose, including, but not limited to grout, paste or mortar. The mixing chamber has a system of interconnected scales and associated computer hardware and software that tracks and records in real time the current weight of each of the materials in the mixing chamber, accounting for unweighed infalling ingredients in this process. Software associated with the mixing chamber and the loaded materials therein allows for the tracking and remote transmission of the weight of each individual ingredient in the mixing chamber. The desired amount of each individual ingredient is predetermined and loaded into the computer operating system. This is then reflected in the batch mixed and ultimately installed.

While the operator of the apparatus controls the recipe for each batch made, the operator cannot make any batch that is not accurate nor accurately recorded.

Ingredients are loaded into the mixing chamber sequentially. As the desired weight of each ingredient is reached within the desired accuracy programmed into the system, the operating system slows down and then shuts off delivery of that ingredient. There can be infinite speeds and/or a slow, curved progression of the speed's increase and decrease, but typically this is done using two preset delivery speeds. A high rate of speed for inputting each ingredient is used when the ingredient is initially added and while the weight of that ingredient is below an identified threshold. When a predetermined percentage of the total amount of the ingredient is reached, the rate of input is slowed by the operating system to a second rate, which is lower than the first rate of input. This slower rate of input is used until the desired total amount of the ingredient is reached, at which time the input is stopped. The system delivers a preselected weight of the liquid ingredient and then, in succession, a first particulate ingredient and the second particulate ingredient, if the second particulate ingredient is required. Additional ingredients may be added as needed. The system comprises storage and delivery means for each of the ingredients, allowing a start to delivery of each ingredient, continued delivery at different rates, depending on the amount of the ingredient being delivered then in the mixing chamber, and stopping delivery of each ingredient when the desired amount of the ingredient in the mixing chamber is accurately reached. The rate of delivery, further, is fully variable, from a low rate to a high rate and complete shut off. Although in practice only two different speeds are typically used by the operators, the two speeds selected are fully variable within a broad range of possible input speeds or can be delivered on a smooth, gradual increase and decrease in speed.

Further, because the weight of each ingredient is measured in the mixing chamber, operators are able to continue to maintain stores of each ingredient by adding additional amounts of each ingredient to the separate storage chambers on a continual basis.

It is commonly known in the field that the mixing of ingredients is made more efficient by the retention in the mixing chamber of some amount of the previous batch of cementitious slurry in the mixing chamber, to which are added ingredients, in the proper order and in preselected weights, as described above, to make additional batches of cementitious slurry. By adding additional ingredients to the partial previous batch, the mixing time needed for the additional ingredients to be ready to pour is substantially reduced, while the quality of the batch is substantially improved. The apparatus's operating system is able to cause the removal from the mixing chamber a specific amount of the mixed batch, retaining a known and desired amount of the previous batch. In the context of the present invention, the software is configured to zero-out the amount of the partial previous batch retained in the mixing chamber before the addition of the ingredients for the next batch. Because of this, only the ingredients for the next batch are measured, resulting in the accurate recording of information as to the qualities of the next batch.

Because quality is capable of being retained by the accurate measurement and recording of information as to each batch, while maintaining a high through-put at the mixer, it is generally possible to pump continuously.

While the operator of the apparatus maintains a high level of control over all of the operations of the apparatus, such as rate of production and recipes for batches produced, the operator cannot operate the apparatus "off-line." All production information is automatically saved and stored by the operating system of the apparatus.

In an exemplary embodiment, a first, a second, and a third ingredient are separately stored in appropriate storage chambers fixedly integrated into the system. Each separate storage chamber is conveyably connected to the mixing chamber using a connection means suitable for the physical characteristics of each ingredient. The liquid storage means may be conveyably connected to the mixing chamber using a pump, a hose, one or more valves and a nozzle. The separate storage chambers for each of the particulate masses are each conveyably connected to the mixing chamber using a suitable conveyor belt or other means for conveying quantities of particulate masses. The means of conveying the liquid and particulate masses are controlled by valves, pumps or motors, which are controlled by the software system. It is noted that while the number of ingredients, storage chambers and apparatus for conveying is given as three, more or fewer ingredients may be used, with additional storage chambers and conveyance apparatus disposed thereon as needed and with control modifications as needed.

Once the human operator has input the recipe for the proportion of ingredients needed, the system software controls the sequential conveyance of all ingredients, including the amount, by weight, of each ingredient to be conveyed to the mixing chamber, the rate of flow of each ingredient into the mixing chamber, and the accuracy of the weight of each ingredient in the mixing chamber.

In the exemplary embodiment, a batch of slurry is prepared in the following fashion, showing the primary inventive elements:

The operator, based on design or construction specifications for a certain type of cementitious product, inputs a recipe for an underlayment slurry into the operating system.

A sufficient quantity of each necessary ingredient is stored in each of the separate storage chambers. The operating system sends a signal causing the liquid ingredients to be pumped into the mixing chamber. During the time that the amount (weight) of the liquid ingredient in the mixing chamber is low, control valves are fully open and the pump is on. The scales connected to the mixing chamber send signals to the operating system in real time as to the weight of the liquid ingredient. When the weight of the liquid ingredient in the mixing chamber reaches a preset limit, which is less than the full amount to be delivered to the mixing chamber, the operating system sends a signal to the valves controlling the rate of flow of the liquid ingredient. The operating system signals the valves to slow the pump a predetermined amount so that the rate of inflow of the liquid ingredient is at a slower rate, still known to the system. When the maximum level is reached, as determined by the scales, the valves are signaled by the operating system to shut completely, stopping the flow of the liquid ingredient. The two rates of inflow are predetermined before mixing begins, but the rates may be altered at any other time to any desired degree.

The speed of the rotation of the mixer blades matches the rate of inflow of an ingredient. While an ingredient is added at a high rate, the mixer blades rotate at a fast rate. When the rate of input of an ingredient is slowed, the rate of mixer blade rotation is slowed. However, when input of an ingredient has stopped, the mixer blades rotate at a slow rate. After all the ingredients are added, the mixer blades speed up to a high rate to ensure an adequately mixed batch.

It is known in the field that conditions under which mixing devices must operate may vary, depending on location, the nature of the project, the experience of the operating crew and the like. The benefit of the system is the fully adjustable control over the rate of inflow which allows a maximal rate of inflow of an ingredient while providing exact control over the amount of the ingredient in the mixing chamber and in light of external conditions. This allows high accuracy without sacrificing speed. Production rates are thereby maintained at a high level despite the external conditions.

In a similar manner, the particulate ingredients are input to the mixing chamber. With the liquid ingredient in the mixing chamber at the correct weight, the operating system sets an initial weight of zero for the second ingredient, a first particulate ingredient (meaning that at first, no first particulate ingredient in is the mixing chamber). The operating system sends a signal to a conveying means connecting the storage chamber for the first particulate ingredient to the mixing chamber. The conveying means inputs the first particulate ingredient at first at a high rate of flow. In the exemplary embodiment, a conveyor belt between the storage chamber and the mixing chamber carries the first particulate ingredient at a known rate. The scales connected to the mixing chamber weigh the amount of first particulate ingredient. At a preset weight, based on the recipe for the desired slurry, the operating system sends a signal to the conveying mean to slow the rate of input of the ingredient. When the desired weight of the first particulate ingredient is reached, the operating system sends a signal to the conveyor belt to stop input of the first particulate ingredient. In the same manner as the liquid ingredient, the rate of input of the first particulate ingredient is maximized while a highly accurate amount of the first particulate ingredient is inputted to the mixing chamber, despite any limitations imposed by external conditions at the work site. Again, mixer blade rotation corresponds to the input rate.

Thereafter, the second particulate ingredient is added to the mixing chamber in a similar, precise, and accurate manner.

For each added ingredient, the apparatus accurately accounts for ingredients in transit. For example, for water, the software accounts for the amount of water which has left the nozzle but not yet reached the mixing chamber (that is, the amount of water in free fall into the mixing chamber). By accounting for the amount of water in transit, the total amount of water in the mixing chamber remains accurate despite any lag between sending the shut off signal for that ingredient and the time the last water reaches the mixing chamber. Similarly, the apparatus accounts for the amount of any particulate ingredient in free fall into the mixing chamber, having been dropped from the conveying means but not yet in the mixing chamber.

The final weight that is recorded for each ingredient is measured with an additional process. Once the system detects the total predetermined weight has been reached (or almost reached), the system closes the valve and then waits to ensure that the predetermined weight holds for a certain time, typically three seconds. The length of time used may be varied by the operator. At the end of three seconds, the weight is recorded. The benefit of the three-second (or other certain time) measuring window is the prevention of recording an erroneous measurement caused by a vibration, jostle, or other environmental effect on or within the apparatus. During the weighing period, the engine powering the apparatus continues to operate. The engine, an approximately 125 BHP diesel engine, typically operates at a sufficiently high rate (1800 RPM +/−) throughout all operations so that errors caused by engine vibration can be eliminated, especially with the ability to calibrate the scale while the engine is running. The extended weighing period for a given ingredient is designed to allow the mixer blades to slow and vibrational and other weighing error sources to dissipate before the final weight of an input ingredient is measured. Similarly, weight over a time period is measured while the mixer blades rotate slowly so as to minimize errors.

Further, because the weight of each ingredient is measured in the mixing chamber, operators are able to continue to maintain stores of each ingredient by replenishing the storage chambers on a continual basis as the batches are being weighed and mixed.

It is commonly known in the field that the mixing of ingredients is made more efficient by the retention in the mixing chamber of some amount of the previous batch of cementitious slurry in the mixing chamber. By adding a new batch's ingredients into the mixing chamber that still contains a portion of the previous batch, the mixing time needed for the new batch's ingredients is substantially reduced and the quality is improved. Once the mixing chamber has fully mixed the ingredients for the requisite time to create properly wetted slurry, the batch is dumped into a holding chamber. The slurry in this holding chamber is then transferred through a hose by a pump for installation. This holding chamber allows simultaneous and continuous mixing and pumping, which increases the speed of the ultimate installation of cementitious slurry.

Further, the amount of slurry in the holding chamber is measured by the computer system so that the mixing chamber will not dump a slurry batch into the holding chamber until there is enough room in the holding chamber. This removes the need for a human operator to supervise the relative speeds of the mixing and pumping operations. If the pumping operations have slowed, the mixer will not create new batches until pumping operations have begun again.

If desired, the operator of the apparatus can maintain a high level of control over all of the operations of the apparatus through the user control interface, such as rate of production and recipes for batches produced. However, the operator cannot operate the apparatus "off-line." All production information is irrevocably and automatically saved and remotely transmitted to an off-site database by the operating system.

The operating system records all steps of the mixing process, which includes the amounts of each ingredient added to the mixing chamber and may include additional mixing or ingredient parameters, such as the time each ingredient was added to the mixing chamber or the time taken to mix the ingredients, ingredients, jobsites, time records, weights, mix times, dump time, operator number, or the like.

The ability of the operating system to transmit the record of each individual batch's production metrics ensures the quality of installation and provides documentation of the precise ratio and weight of each individual ingredient in each batch installed at any particular job. This allows operators to provide assurances and guarantees that the products installed from the system met the manufacturer's and/or customer's design specifications.

In addition, the available metrics provide useful management tools, such as measuring productivity, when the apparatus is in operation (and conversely when it is not in operation), and any other related or measurable metric related to the operation of the apparatus. This information can be provided via remote transmission to management, and therefore eliminates the need for certain on-site supervision man hours.

The invention is thus able to provide a higher quality final product, both as to the accuracy of the ingredients and the consistency to which the ingredients are mixed, produced at a high rate of production and in which both operator error and operator misconduct are avoided and prevented. Further, the invention provides for the remote transmission of the qualities of the final product, which assures quality and management control.

BRIEF DESCRIPTION OF THE DRAWINGS

FIG. 6 further depicts a graph of the mixer speed during ingredient conveyance.

DETAILED DESCRIPTION OF THE DRAWINGS

The invention is capable of mixing at a worksite high quality slurry for use in various areas of the construction industry in which it is necessary to know the ingredients of the slurry to a high accuracy as well as to create and maintain a permanent, portable or transmittable record of the manufacturing of the slurry for quality assurances purposes.

Figure 2:
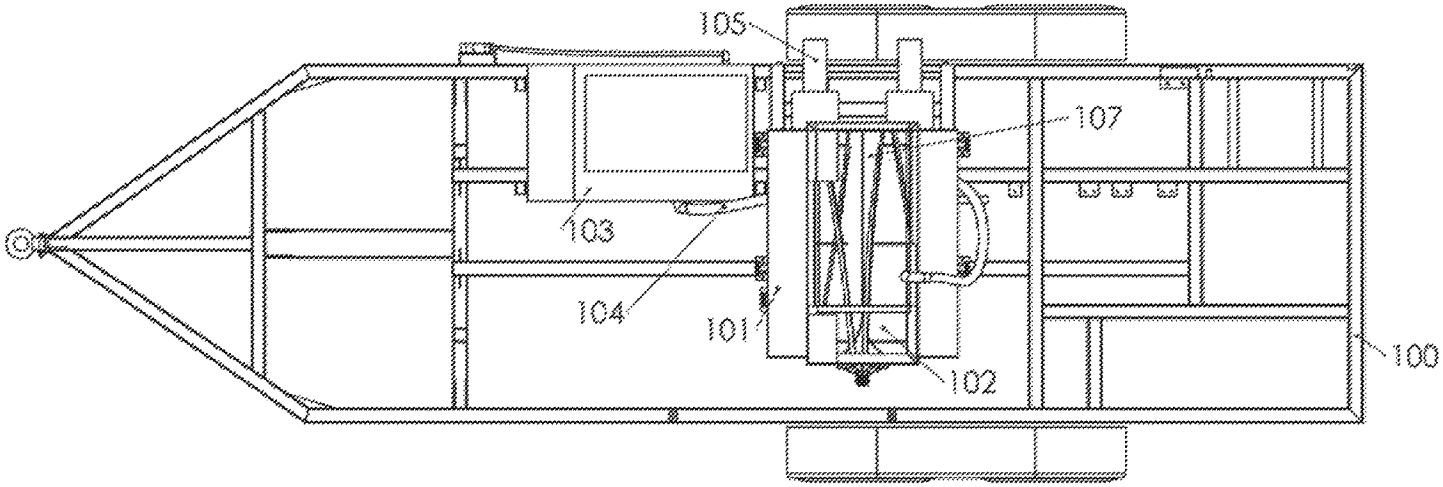
FIG. 2 depicts a top view of the same items.
Figure 1:
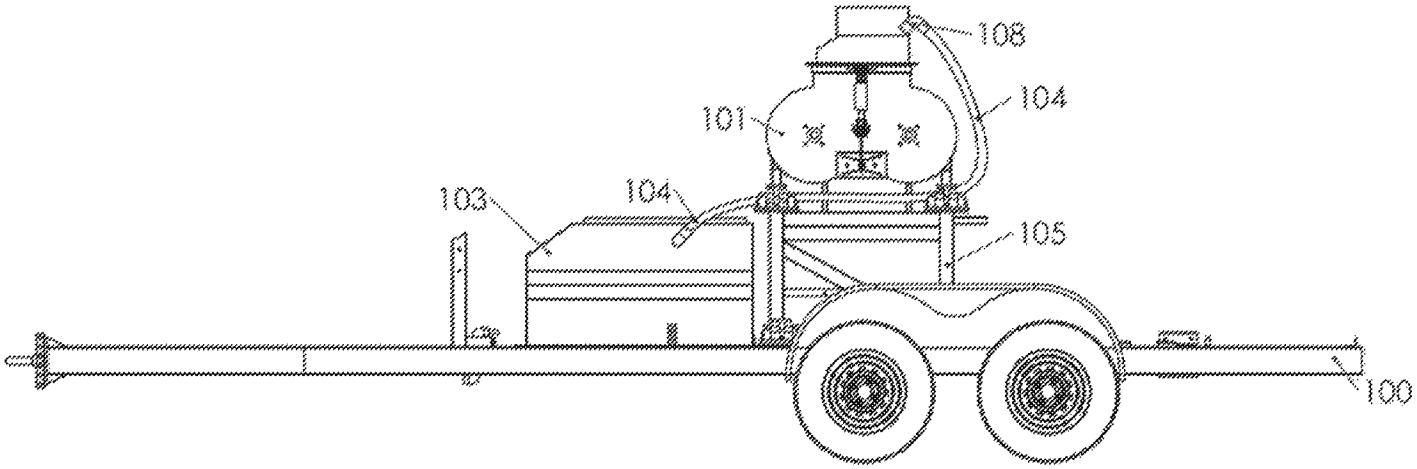
FIG. 1 depicts a side view of the water tank and mixing chamber of the invention, showing the stand on which the mixing chamber is placed, as well as the hose and nozzle to transfer water to the mixing chamber.

FIGS. 1 and 2 show aspects of the invention relative to introducing water to the mixing area for forming slurry. A wheeled, hitchable, steel-beam flatbed trailer 100 has affixed to it a steel-beam platform 105 suitable for mounting thereon a mixing chamber 101 known in the industry. A trailer 100 is not mandatory. The apparatus may be equally mounted on a truck, mobile skid or similar transportable base. Similarly, configurations of the components as depicted in the figures are not mandatory, nor is the invention limited to two or three ingredients. The invention may have storage chambers and conveyance apparatus in such numbers, operational configurations and design as needed. Design and configuration variations are determined by the nature of the slurry to be prepared. As better depicted in FIG. 2, the mixing chamber 101 has an opening 102 at its top side able to receive a variety of ingredients necessary or useful for making cementitious slurry. Disposed within the mixing chamber 101 are mixing blades 107 for mixing the added ingredients. The trailer 100 also has affixed to it a water-tight tank 103 of suitable volume for storing an adequate and refillable supply of water or other liquids necessary for operations at a work site. One end of a hose 104 is sealably placed through one wall of the tank 103 and is connected to a pump (not depicted) disposed within the tank. The other end of the hose 104 has disposed on it a nozzle 108 suitably designed to allow water or other liquids to be pumped from the tank 103 into the mixing chamber 101 through the top opening 102 without spillage, spraying or other loss. The pump is controlled by an operating system 301, depicted in FIG. 3 and FIG. 11, which controls and digitally records all aspects of the operation of the apparatus. The rate of water flow into the mixing chamber 101 is limited physically by control of the rate of speed of the pump by opening or closing of the hydraulic valves disposed on the hose between the pump and nozzle 108. Valves are controlled electronically. The pump and valves used in the invention may be any suitable pump and/or the hydraulic valves of known design and operational parameters in the industry.

The hose 104 is fluidly connected from the tank 103 to the opening 102 of the mixing chamber 101, with the nozzle 108 of the hose removably affixed to the top of the mixing chamber 101 so as to allow water or other liquid to flow into the mixing chamber 101 through the opening 102. In an alternate embodiment, the nozzle 108 may be placed through a wall of the mixing chamber 101 at any unobstructed position to allow water to be introduced into the mixing chamber 101 as needed.

Figure 3:
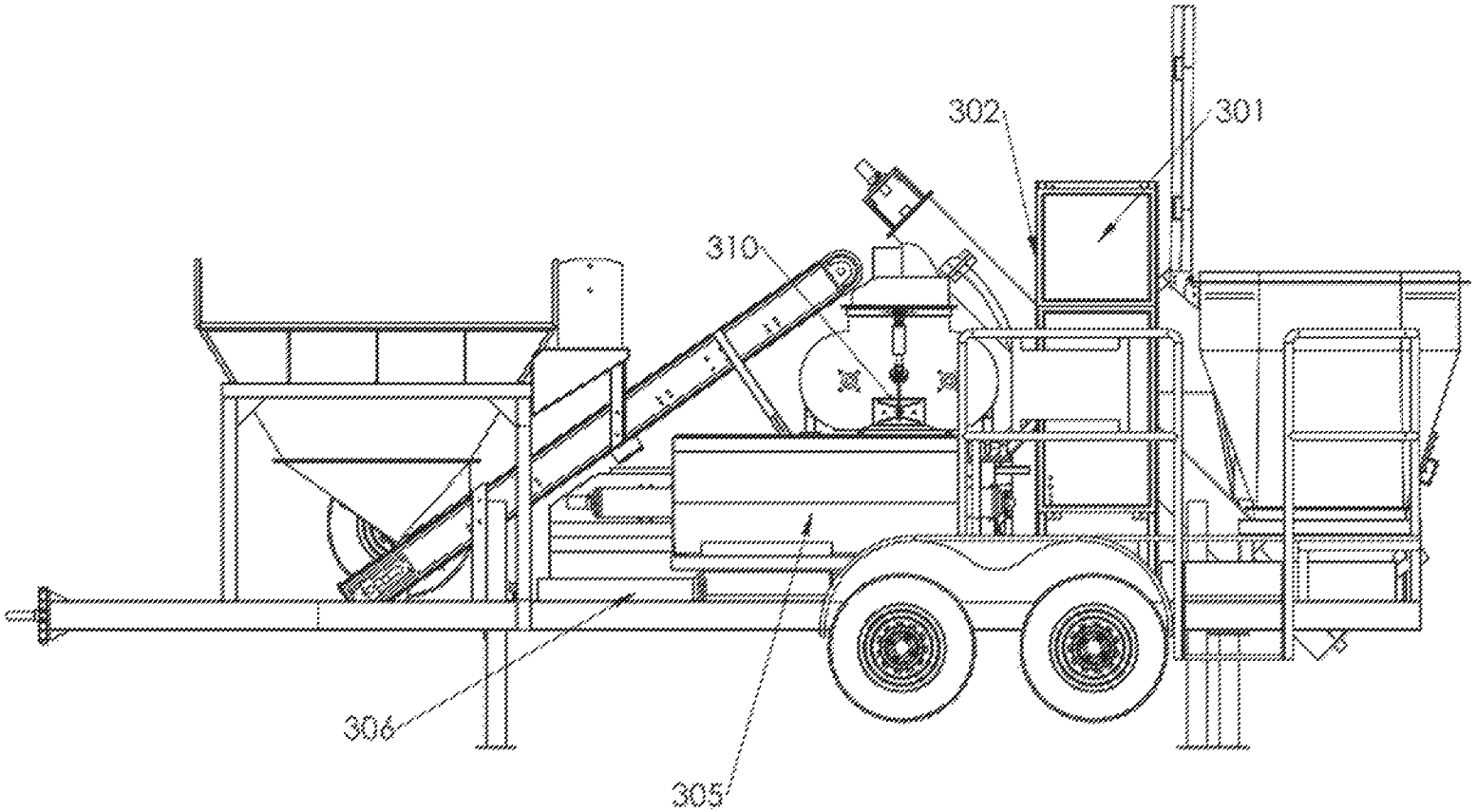
FIG. 3 depicts a side view of the assembled apparatus showing primary components of the apparatus.
Figure 11:
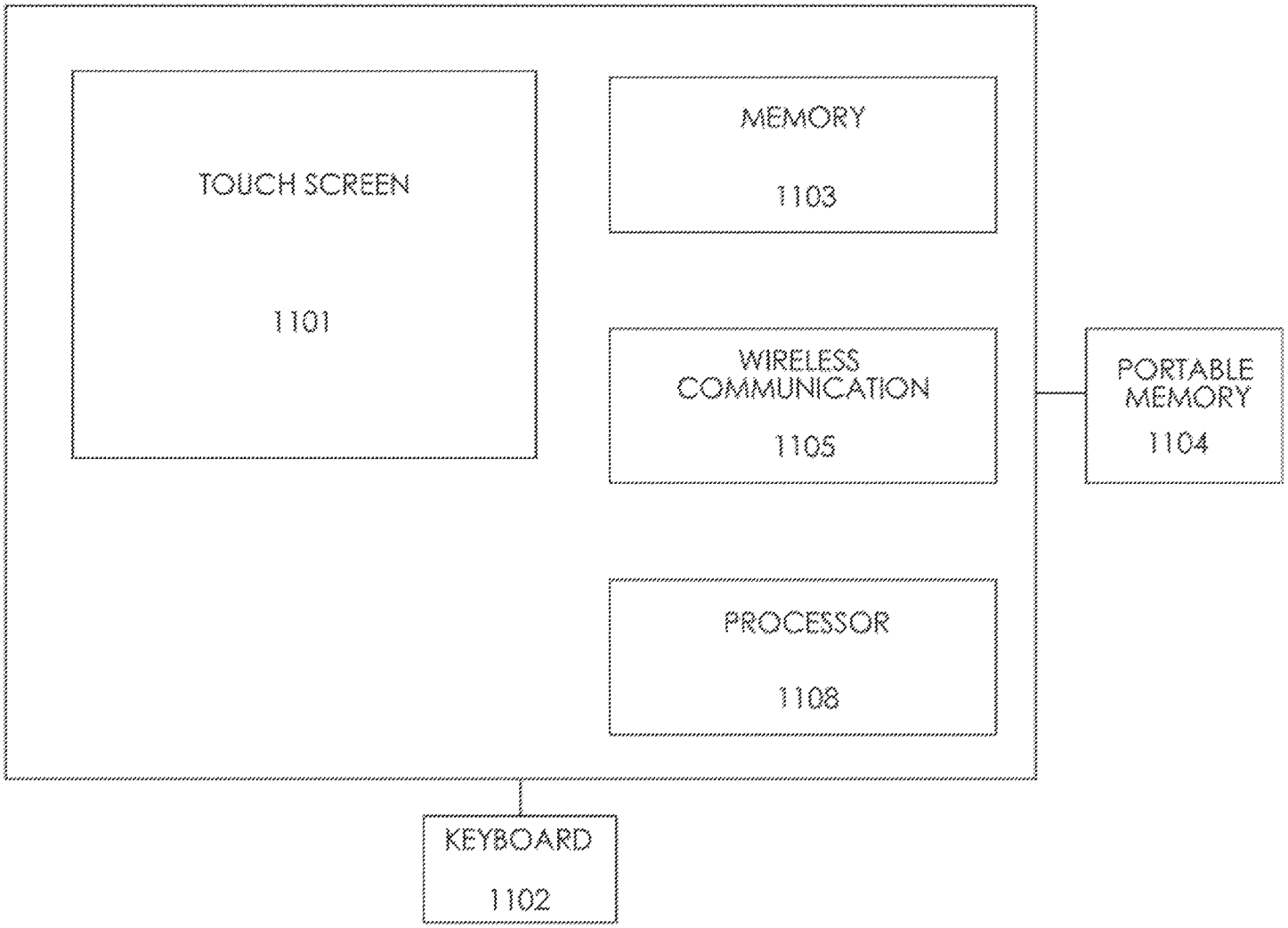
FIG. 11 depicts a schematic of the major operational components of the operating system.

Referring to FIGS. 3 and 11, operation of the apparatus is attained by use of a software-based operating system 301 disposed in a suitable work station 302 on the apparatus. During operation, a worker selects from a list of preprogrammed recipes or enters an ingredient list, weights of the ingredients, and mixing time into the operating system 301 to create a new recipe. In practice, this information may be entered manually, as by keyboard 1102, touchscreen 1101, portable memory device 1104 or similar method, or remotely, such as by wireless communication 1105, into the operating system 301. Software for the operating system 301 is proprietary but is not otherwise disclosed. The operating system 301 is wired by any suitable means to all operative features of the apparatus and controls all operational functions of the apparatus. The operating system 301 further includes memory storage 1103, a processor 1108 for running operational programming, and wired or wireless data transmission means 1105.

Figure 4:
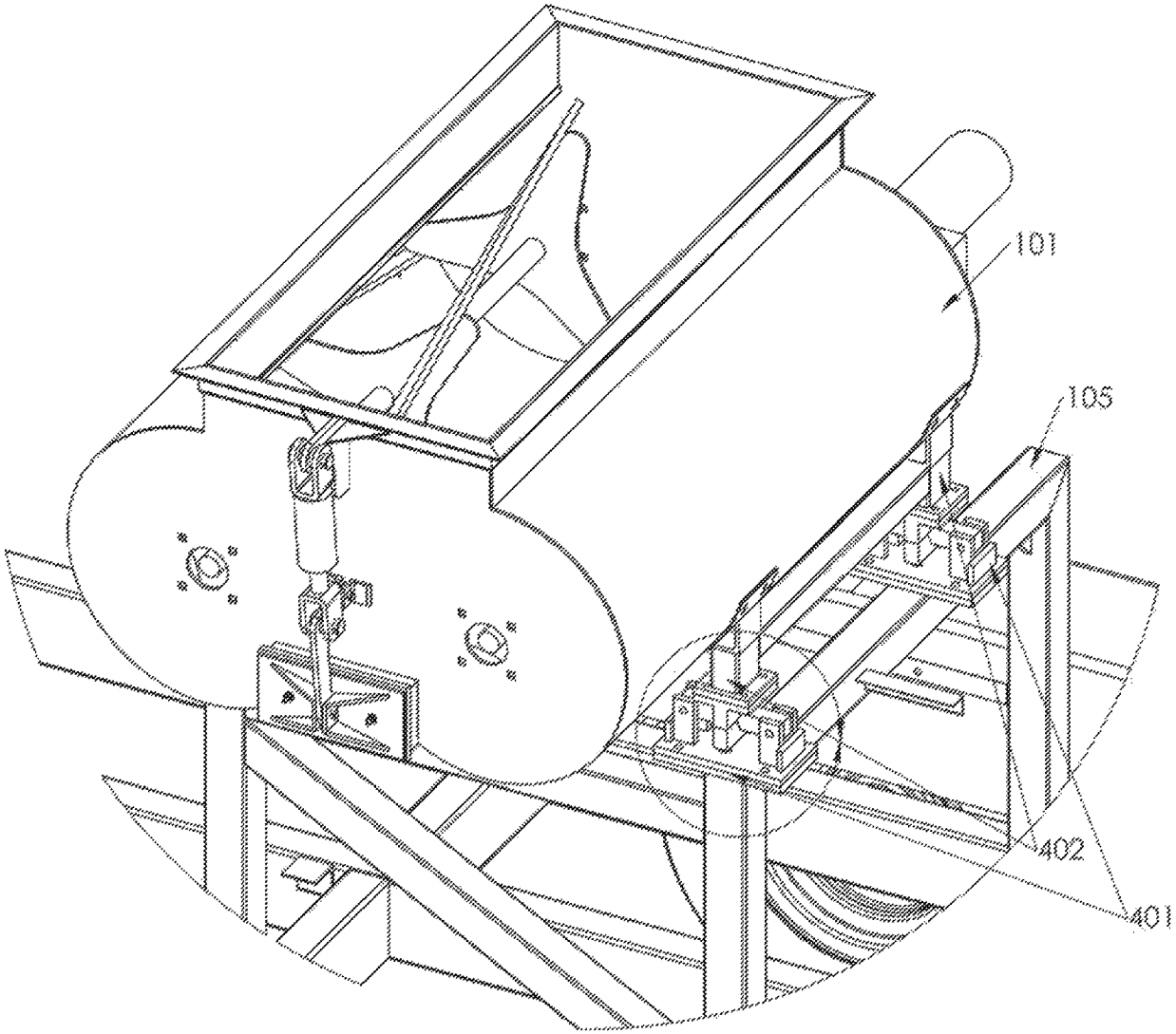
FIG. 4 depicts a perspective view of the mixing chamber, showing two of the strain gauge load cells used to weigh ingredients added to the mixing chamber.

Referring to FIGS. 1, 3, and 4, at the start of the operational run of the apparatus in an exemplary embodiment of the invention, a recipe for slurry production is entered into the operating system 301, and the operating system 301 determines the tare weight of the mixing chamber 101. In essence, in operation the tare weight is a zero point of the system—that is, with no ingredients in the mixing chamber 101 for a particular batch of slurry. Depending on the circumstances of the operation of the apparatus, the tare weight of the mixing chamber 101 may be the weight of the mixing chamber 101 empty or it may be the mixing chamber 101 with some amount of previously mixed slurry still in the mixing chamber 101. It can be advantageous to the mixing of a subsequent batch of slurry to retain a predetermined portion of a previous batch of slurry in the mixing chamber 101 to allow for more thorough and faster mixing of the subsequent batch using some portion of the previous batch as a "catalyst" for mixing. It is not necessarily intended that reference to the previously mixed slurry in the mixing chamber 101 as a "catalyst" is used here in a literal or technical sense but as a metaphor for improved mixing time and thoroughness based on the physical characteristics of the previously mixed slurry retained in the mixing chamber 101. After setting the tare weight, the information is stored in memory 1103. In addition, the memory 1103 stores the recipe for the slurry to be made along with all other operational information of the production run.

During a production run, the operating system typically determines the amount of slurry to be left in the mixing chamber 101, which may be any amount of the previous batch sufficient to aid subsequent operations. However, in alternate embodiments of the invention, the determination of the amount of slurry left in the mixing chamber 101 from a previous batch may be automatically determined based on environmental conditions or production needs and as determined by sensors, such as temperature sensors, moisture sensors, sensors for determining the density of a slurry or the like. A failure to list a type of sensor or the data a sensor might detect is not a limiting factor in alternative embodiments of the invention. Any suitable sensor measuring any suitable quality of the slurry or the apparatus may be used.

Figure 5:
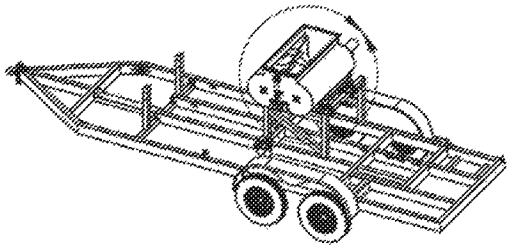
FIG. 5 depicts a perspective of one of the strain gauge load cells used to weigh ingredients added to the mixing chamber.
Figure 5:
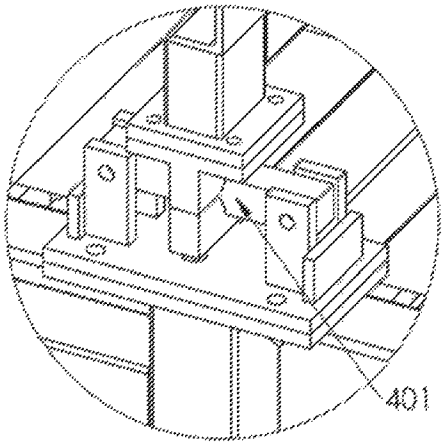

Referring to FIG. 4, the mixing chamber 101 is affixed to the platform 105 by the use of a set of four strain gauge load cells 401, commonly referred to as a "scale" when referring to one strain gauge load cell or "scales" when referring to more than one strain gauge load cell, for weighing the amount of each ingredient delivered in the mixing chamber 101. In FIG. 4, only two strain gauges 401 are visible. The other two strain gauges 401 are configured in a like manner on the opposite side of the mixing chamber 101. A detail depicting a single scale is shown in FIG. 5. The scales 401 are interposed between the each one of four feet 402 on the mixing chamber 101. Each of the scales 401 is wired to a centralized weight computing unit, which is wired to the operating system 301 so as to enable electronic communication between the scales 401 and the operating system 301. Wiring may be accomplished by any standard method and is not depicted in the figures.

In an operational run, a worker either selects a preprogrammed recipe or enters an ingredient list, desired weights, and mixing time into the operating system 301 and starts the operation of the apparatus. The operating system 301 activates the scales 401 to set the tare weight of the mixing chamber 101. Mixing of slurry begins when the pump in the water tank 103 is activated by the operating system 301, starting the flow of water into the mixing chamber 101. While other liquids may be used, water is the typical liquid ingredient and will be described in this exemplary embodiment. At the start of the flow of water, the hydraulic water pump in the water tank 103 is activated by the operating system 301 for a fast flow of water. Valves are opened to permit the pump to cause a high rate of flow of water into the mixing chamber 101. The operating system 301 measures the weight of water in the mixing chamber 101 using the set of scales 401 in real time. A software algorithm therefrom determines the weight of water accurately. The operating system 301 uses that measurement to determine whether to maintain the rate of water flow into the mixing chamber 101 or to modify it.

When the weight of the water in the mixing chamber 101 reaches a preprogrammed, predetermined threshold as set in the operating system 301 software, the operating system 301 sends a signal to the hydraulic control valves controlling the pump to slow the input rate to a slower but still known rate of input. Real time weighing of the water in the mixing chamber 101 by the scales 401 is continuous throughout. When the weight of the water in the mixing chamber 101 reaches a final threshold determined by the recipe, the operating system 301 signals the hydraulic valves to stop the pump. The operating system 301 software is configured to account for the amount of water which has been emitted from the nozzle 108 but which has not yet fallen into the mixing chamber 101 to be weighed. Thus, the operating system 301 can be seen to anticipate this additional amount of water not yet measured in the mixing chamber 101 following shut off of the pump and closing of the valves. The weight of the water in the mixing chamber 101 which causes the signal to shut off the pump is thus:

(total weight of water desired as an ingredient)−(weight of water in freefall between nozzle and mixing chamber)=(weight of water sufficient to signal pump shut-off).

By this method, after the shutting off of the pump and the weighing of the water in the mixing chamber 101, the total weight of water in the mixing chamber 101 will be within a specified, low tolerance of the specified amount programmed into the operating system 301.

Figure 6:
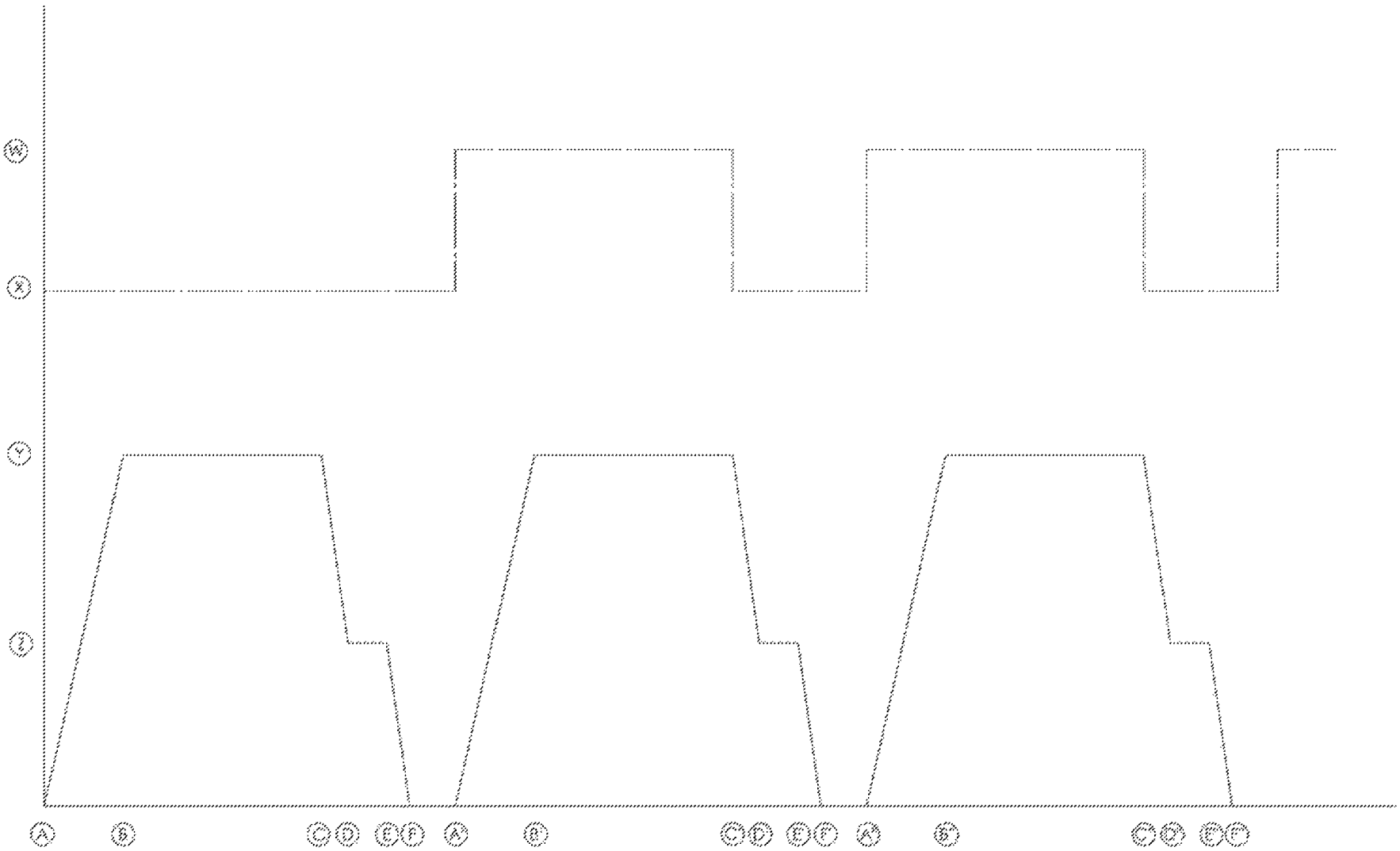
FIG. 6 depicts a graph showing an exemplary rate of conveyance of three separate ingredients into the mixing chamber during a representative production run of the invention.

FIG. 6 depicts typical rates of flow of ingredients into the mixing chamber. Note that the rate of changes of the weight of each ingredient in the mixing chamber 101 is arbitrary. The horizontal axis of FIG. 6 represents time. The vertical axis for ingredients (lower graph) represents rate of flow. The vertical axis in the top graph represents mixer blade speed. At point A on the graph, the flow rate of water is 0 gallons per minute, indicating the pump is not activated. When activated, with the pump set for a high rate of flow, the flow rate at point B on the graph quickly reaches Y gallons per minute, an arbitrary rate of flow. This rate is held steady while water flows into the mixing chamber 101, during which time the weight of the water is weighed in real time. Point C on the graph indicates the time at which the weight of the water in the mixing chamber reaches the pre-set midpoint threshold. At that time, the operating system 301 signals the hydraulic valves to operate the pump at a slower speed to allow a slower input rate, Z gallons per minute, another arbitrary rate of flow and in which Z<Y, reflected at point D on the graph. This slower rate of input continues until the final threshold weight of water is reached, at which time the operating system 301 signals the valves to close, and the pump stops, as reflected at point E on the graph. A small amount of water, the weight of which is known, falls into the mixing chamber, reflected at point F on the graph, showing the full desired amount of water in the mixing chamber. In this exemplary embodiment, Y>>Z. In alternate embodiments, rates of flow may include Y', in which Y<Y', or Y", in which Y>Y", with similar variability expressed for Z, Z', Z" and so forth.

As further described in FIG. 6, top graph, while the rate of input of the water is fast, the mixing blades 107 rotate slowly. Slow speed X is arbitrary in this representation.

It is thus seen that the operating system 301 typically controls the rate of input of an ingredient, currently, water, in a trinary system—off, fast input and slow input rates. It is noted, however, that the operating system 301 allows a fully variable range of speeds for inputted ingredients. The "fast" setting may vary, depending on need, from Y gallons per minute to Y' gallons per minute, to Y" gallons per minute, or any rate in-between and with the Y, Y' and Y" values determined on conditions such as pump or valve capabilities, worksite conditions, slurry type and so forth. Similarly, lower rates of input for the Z, Z' and Z" rates of flow are fully variable except that a given Y value will always be greater than its accompanying Z value. The alternative, in which Y<Z is possible, but of no practical value. Rates of change between a "Y" rate and a "Z" rate may also be controlled by the operating system along any rate of change.

The operating system 301 further creates and stores data in memory 1103 relative to each production batch during operation, including a batch identifier, worksite information, the weight of the each ingredient added to the mixing chamber in the batch, the identity of each ingredient in the batch, mixing time and other information useful for quality control.

Following completion of the addition of water to the mixing chamber 101, the amount of water is weighed by the following process: the speed of the engine operating the apparatus is maintained at a constant rate and the mixing blades 107 are maintained at a slow speed. The operating system 301 then measures the weight of the water in the mixing chamber 101 for a predetermined period, typically 3 seconds. By allowing a known level of systemic vibration only to be accounted for, the actual weight of the water is determinable to high precision. Other sources of vibration and weighing error are damped from the system, such that a more accurate measure of the weight is obtained. The weight of the water in the mixing chamber 101 is confirmed to have held steady for the waiting period and then recorded. This process is also depicted in FIG. 6. Water is added to the mixing chamber 101 from times A through F. At time F, all input into the mixing chamber 101 is paused. This pause lasts from time F until time A', the weighing period. Following the weighing, the final weight of the ingredient is assured and recorded to the operating system memory 1103.

Still referring to FIG. 6, at time A', the operating system 301 signals the input of cementitious powder into the mixing chamber 101. Similar steps to inputting cementitious powder are used, as reflected at times A' through F'. Between times A' through C', the operating system 301 causes the mixing blades 107 to operated at high speed. At time C', the mixing blades 107 are signaled to operate at slow speed. In a similar fashion, from times F' through A", no ingredients are inputted into the mixing chamber 101, the mixing blades 107 are operated at slow speed and the weight of the cementitious powder in the mixing chamber 107 is assured and recorded in memory 1103.

At time A", a similar process is followed for the loading of the filler, as depicted from time A" through time F", with a suitable period for assuring and recording the weight of the filler in a like manner.

The lengths of the pauses have been programmed to allow internal and systemic vibrations to dissipate from the apparatus. In doing so, a far more accurate determination of the weight of each ingredient can be made. Pauses of approximately 2 seconds to approximately 10 seconds are also typical.

Figure 8:
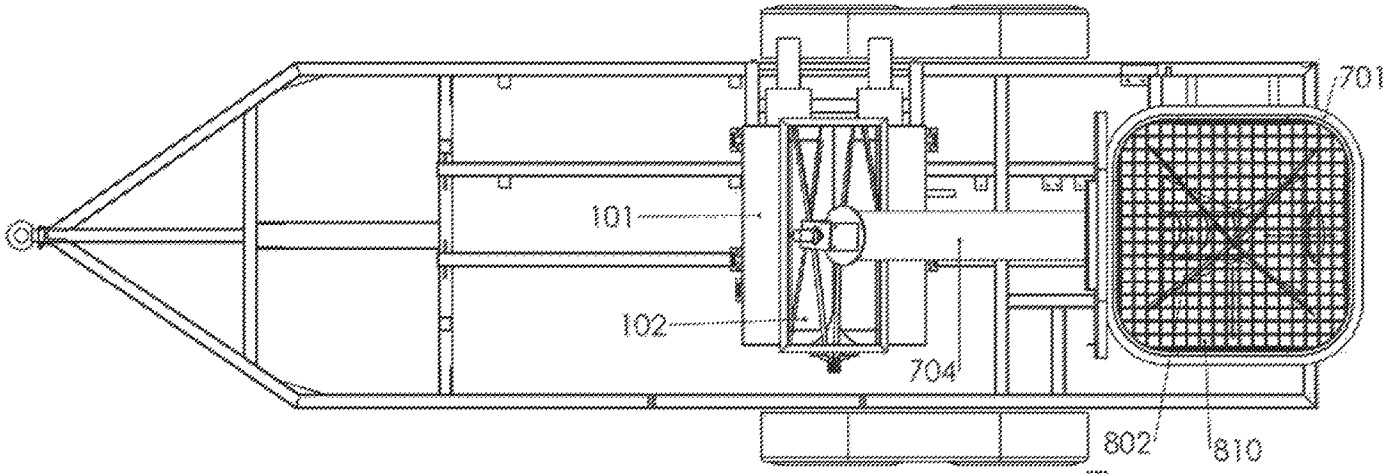
FIG. 8 depicts a top view of the cement bin, showing additional details of the auger system used to deliver cement, gypsum or other binder to the mixing chamber.
Figure 7:
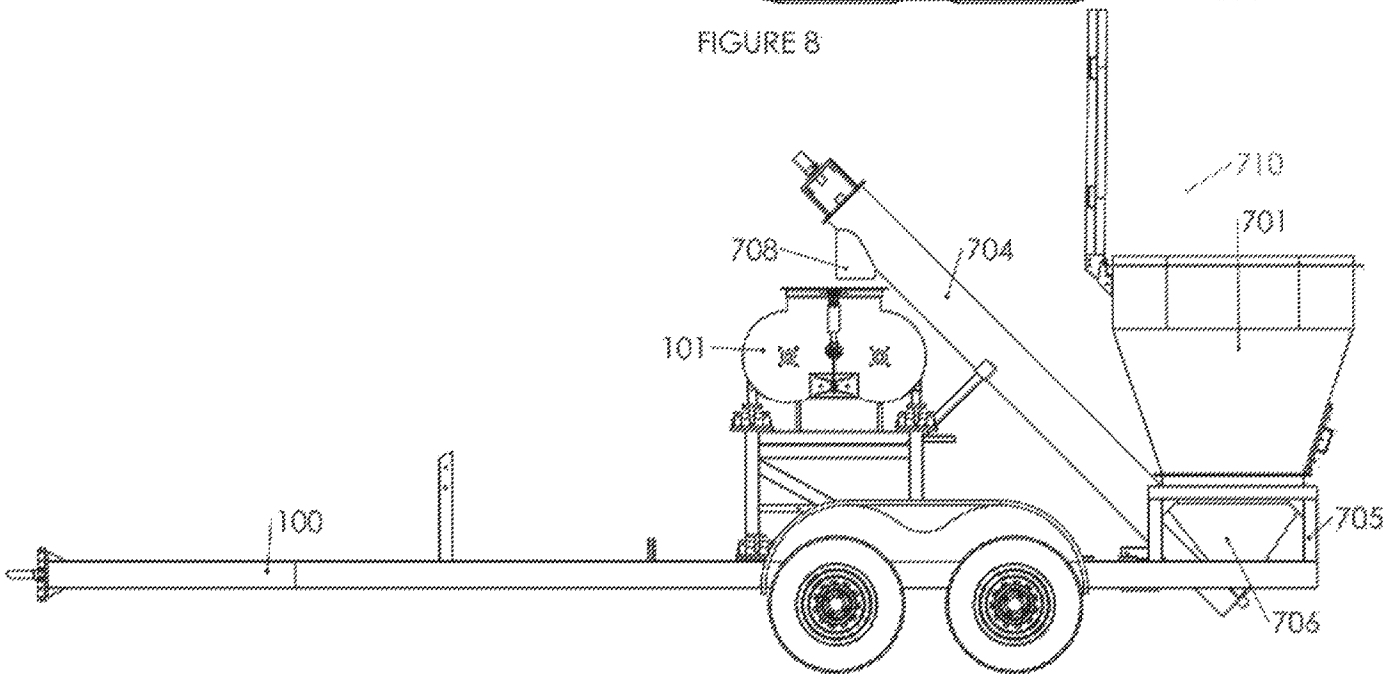
FIG. 7 depicts a side view of the cement bin, showing in addition the auger system used to deliver cement, gypsum or other binder to the mixing chamber.

Having added the water, the next ingredient, typically a binder in the form of a cementitious powder, may be added. Referring to FIG. 7 and FIG. 8, on the steel beam, flatbed trailer 100 previously described also has disposed on it a steel beam platform 705 on which a bin 701 suitable for storing a cementitious powder is affixed. A bin lid 710 is hingedly attached to the bin 701 to control emissions and prevent foreign matter from entering the bin 701. A grate 810 is further disposed atop the bin 701 below the bin lid 710 when in a closed position to prevent foreign objects from entering the bin 701 and to act as a safety device to prevent workers at the worksite from falling into the bin 701 or otherwise contacting the inner surface of the bin 701 directly.

The base of the bin 701 is attached to a coupler 706 for connecting to the bin 701 to a powder delivery tube 704 for delivering the cementitious powder into the mixing chamber 101. Within the powder delivery tube 704 is an auger 802 of known design powered by a motor and controlled by the operating system 301. An exit port 708 distal on the powder delivery tube 704 to the coupler 706 allows the cementitious powder to exit the auger 802 from above the mixing chamber opening 102 to allow infall of the cementitious powder into the mixing chamber 101.

The bin 701 may be filled by workers by emptying either bulk or bagged quantities of a desired cementitious powder into the bin.

Upon inputting a recipe of ingredients for a batch of slurry into the operating system 301, and upon completion of inputting water in the mixing chamber 101, the operating system 301 again sets the tare weight to zero, indicting no amount of the next ingredient, in this case the cementitious powder, has been added to the mixing chamber 101. Then, the operating system signals the hydraulic valves to operate the motor for the auger 802 to run. The cementitious powder in the bin 701 is carried along the auger 802 disposed within the powder delivery tube 704 and infalls into the mixing chamber 101 via the exit port 708. As with the water, the operating system 301 weighs the input amount of cementitious powder in real time using the scales 401. Referring to FIG. 6, as with the water, at first the rate of input of the cementitious powder is at a high rate of speed (still identified as an arbitrary Y pounds per minute) until the weight of the cementitious powder in the mixing chamber 101 reaches a pre-set threshold.

The arbitrary rate of Y gallons per minute for water does not connote to the arbitrary rate of Y pounds per minute for cementitious powder. The rates are identified for scale only. Any rate of input for any ingredient in a portable mixing apparatus may be used.

When the pre-set threshold is reached, the operating system 301 signals the hydraulic valves to operate the motor to slow the auger 802 such that the rate of input of the cementitious powder is slowed to arbitrary rate Z, in which Y>>Z. As with the water input, the operating system 301 software is configured to allow for a known amount of cementitious powder which has fallen from the exit port 708 but not yet landed in the mixing chamber 101 so as to determine an accurate time at which to stop all inflow into the mixing chamber 101. By this method, the quantity of cementitious powder placed into the bin 701 is known to within a narrow tolerance. When the pre-set final threshold weight of cementitious powder in the mixing chamber 101 is reached, the operating system 301 signals the hydraulic valves to stop the augur 802.

During the process of adding the cementitious powder to the mixing chamber 101, the operating system 301 directs and controls the movement of the mixing blades 107, also as depicted in FIG. 6. Between times A' and C', the mixing blades 107 operate at high speed. From times C' to A", the mixing blades 107 operate at slow speed.

FIG. 6 depicts the input of cementitious powder into the mixing chamber 101. Times for the inputting of cementitious powder extend from time A' through time F'. Again, the weight of the cementitious powder added to the mixing chamber 101 is measured and recorded in the same manner as the water during the programmed system pause between time F' and time A". The operating system 301 subtracts from the total weight recorded the weight of the water so that only the weight of the cementitious powder is retained.

An inventive element of the invention is the ability to input multiple ingredients for cementitious slurry in which a highly accurate weight of each ingredient is provided while allowing a high rate of input for each ingredient, such that said high rates of input of each ingredient can be separately and variably controlled as to need for an individual batch of cementitious slurry.

Figure 10:
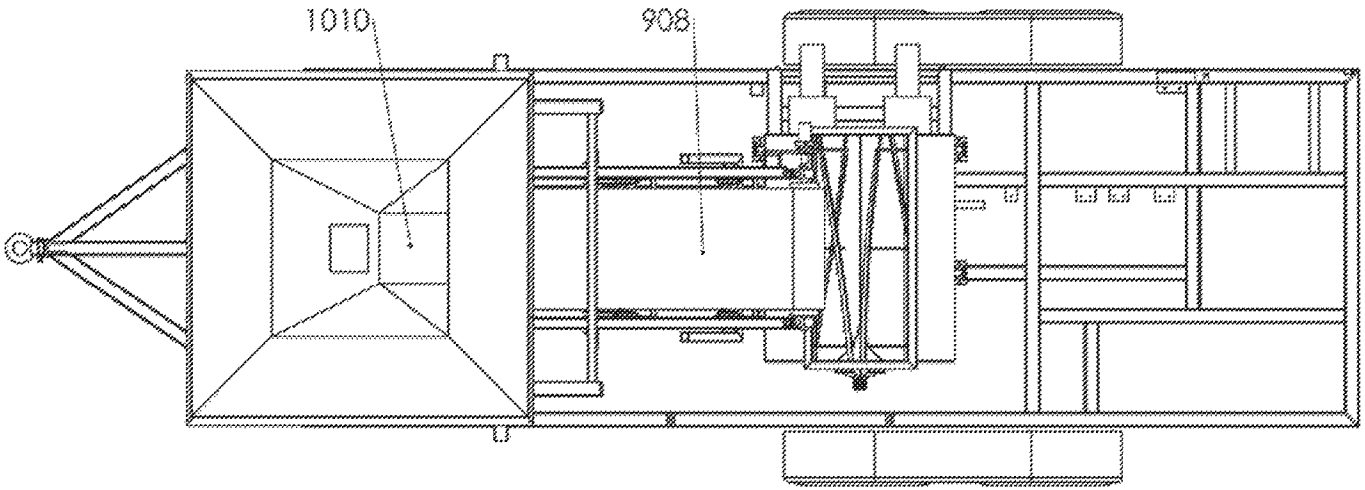
FIG. 10 depicts a top view of the sand bin and conveyor use to deliver sand to the mixing chamber.
Figure 9:
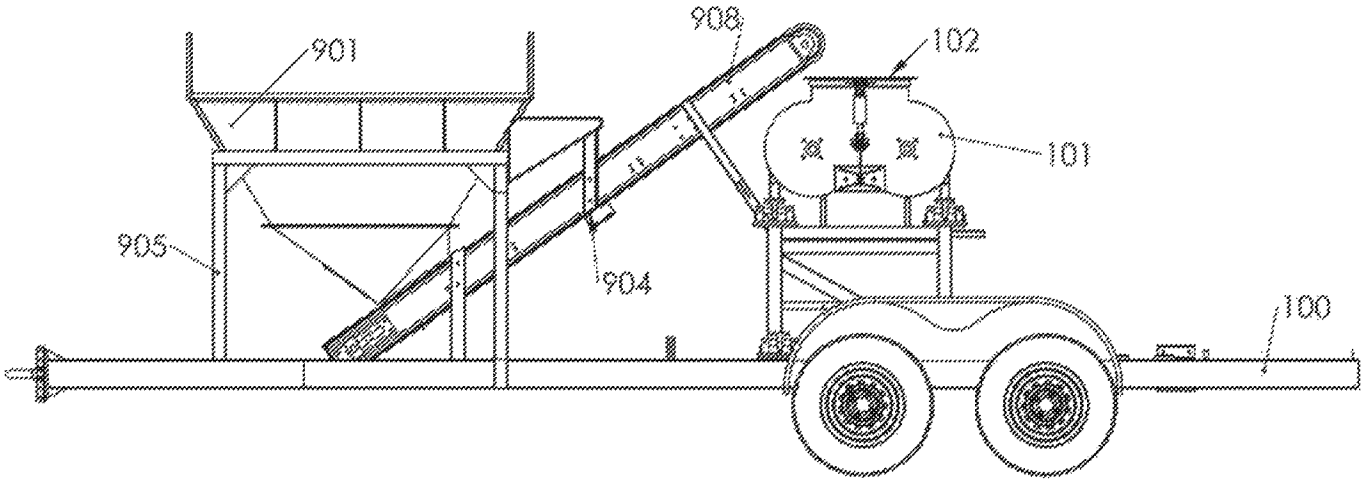
FIG. 9 depicts a side view of the sand bin, showing in addition the conveyor used to deliver sand to the mixing chamber.

Referring now to FIGS. 9 and 10, aspects of the invention are provided for the input of a second powder ingredient, if desired, and typically a filler, such as an aggregate, into the mixing chamber 101. On the steel beam, flatbed trailer 100 previously described is disposed a steel beam platform 905 on which is disposed a hopper 901 suitable for storing a filler for cementitious slurry. A typical filler is sand. The base of the hopper 901 contains thereon a variably openable port 1010 through which the filler passes in order to be conveyed into the mixing chamber 101. Positioned immediately below the variably openable port 1010 is a conveyor belt 908 endlessly rotatably covering a conveyor 904 positioned to convey the filler from the hopper 901 to the mixing chamber opening 101. The conveyor belt 908 is operated by a motor controlled by the operating system 301.

Upon inputting of the ingredients for a batch of slurry into the operating system 301, and upon completion of inputting water in the mixing chamber 101, and upon completion of inputting the cementitious powder into the mixing chamber 101, the operating system 301 again sets the tare weight to zero, indicting no amount of the next ingredient, in this case the filler, has been added to the mixing chamber 101. Then, the operating system signals the hydraulic valves to operate the motor for the conveyor belt 908 to start. The filler passes through the variably openable port 1010, falls upon the conveyor belt 908 and is carried on the conveyor belt 908 until it infalls into the mixing chamber 101. As with the water, the operating system 301 weighs the input amount of filler in real time using the scales 401. As with the water, at first the rate of input of the filler is at a high rate of speed (here again identified as an arbitrary Y pounds per minute) until the weight of the filler in the mixing chamber 101 reaches a pre-set threshold. At that time, the operating system 301 signals the motor to slow the conveyor belt 908 such that the rate of input of the aggregate is slowed to arbitrary rate Z, in which Y>>Z. As with the water input, the operating system 301 software is configured to allow for a known amount of filler which has fallen from the conveyor belt 908 into the mixing chamber 101 but not yet landed in the mixing chamber 101 so as to determine an accurate time at which to stop all inflow into the mixing chamber 101 and to ensure that a highly accurate amount of filler is loaded into the mixing chamber 101.

During the process of adding the filler to the mixing chamber 101, the operating system 301 directs the hydraulic valves to control the movement of the mixing blades 107. As with the loading of cementitious binder, the loading of filler into the hopper 901 may be performed by workers placing bulk or bagged filler into the hopper 901.

FIG. 6 depicts the input of filler into the mixing chamber 101 as described for the cementitious powder. Further, FIG. 6 depicts the input times between time A" and time F". In the same manner as the weighing of water input and cementitious powder, the operating system 301 weighs and records the amount of filler inputted into the mixing chamber 101 during a pause after time F".

Referring to FIG. 3 and FIG. 6, it is noted that during each stage of input of each ingredient, the operating system 301 provides signals to the hydraulic valves to control the motor driving the mixing blades 107 to turn to mix the ingredients. The rate of rotation for the mixing blades 107 is either predetermined or, if desired, may be input into the operating system 301 by the operator by any known method. Depending upon need at the worksite and the required characteristics of the cementitious slurry to be poured, the mixing blades 107 may operate at any desired speed.

Each of the storage containers for the slurry ingredients, i.e. the tank 103, cementitious powder bin 701 or filler hopper 901, are configured on the steel beam, flatbed trailer 100 to allow the addition of additional ingredients to be stored for use. As such, during the mixing of a batch of cementitious slurry, as or after water is conveyed from the tank 104 to the mixing chamber 101, additional water may be pumped to the tank 104 from an external source. Likewise, as or after cementitious powder is conveyed from the bin 701 to the mixing chamber 101, additional cementitious powder may be added by workers loading bags of cementitious powder from bags or bulk loaded through the top of the bin 701. Similarly, workers may add additional reserves of filler into the hopper 901 as or after the conveyance of filler from the hopper 901 to the mixing chamber 101. By this, the invention is enabled, in part, to allow for continual batch processing.

The mixing blades continually run while the ingredients are delivered into the mixing chamber 101. After all ingredients have been delivered, weighed and recorded, the mixing blades 107 in the mixing chamber 101 mix the ingredients at a faster rotation for the predetermined time. A typical mixing time is about 20 seconds, but any suitable time may be used.

Referring again to FIG. 3, upon completion of each batch mixed in the mixing chamber 101, some portion of the batch is removed using the mixing blades 107 from the mixing chamber 101 through a port 310 on the side of the mixing chamber 101. As described above, a portion of the batch is retained in the mixing chamber 101 to aid mixing of the following batch. The portion of the batch removed from the mixing chamber 101 is poured into the wet hopper 305. A progressive cavity pump 306 located beneath the holding chamber 305 operates the flow of slurry from the holding chamber 305 through the hose used to deliver the final slurry product to the desired location.

In determining the amount of slurry to be removed from the mixing chamber 101 to the holding chamber 305, the operating system uses the scales 401 to weigh the amount of slurry remaining in the mixing chamber 101. When the pre-set amount of slurry has been removed to the holding chamber 305, the operating system 301 closes the port on the side of the mixing chamber, stopping removal of slurry. The next batch of slurry may then be prepared following the protocol above.

The holding chamber 305 is also placed on a scale (not depicted) to measure its weight in real time. This scale in connected through wiring to the operating system. The operating system 301 will not allow the mixing chamber to dump slurry into the holding chamber 305 until the progressive cavity pump has pumped enough slurry out of the holding chamber 305 to allow enough room for the slurry to be dumped from the mixing chamber 101.

Figure 12:
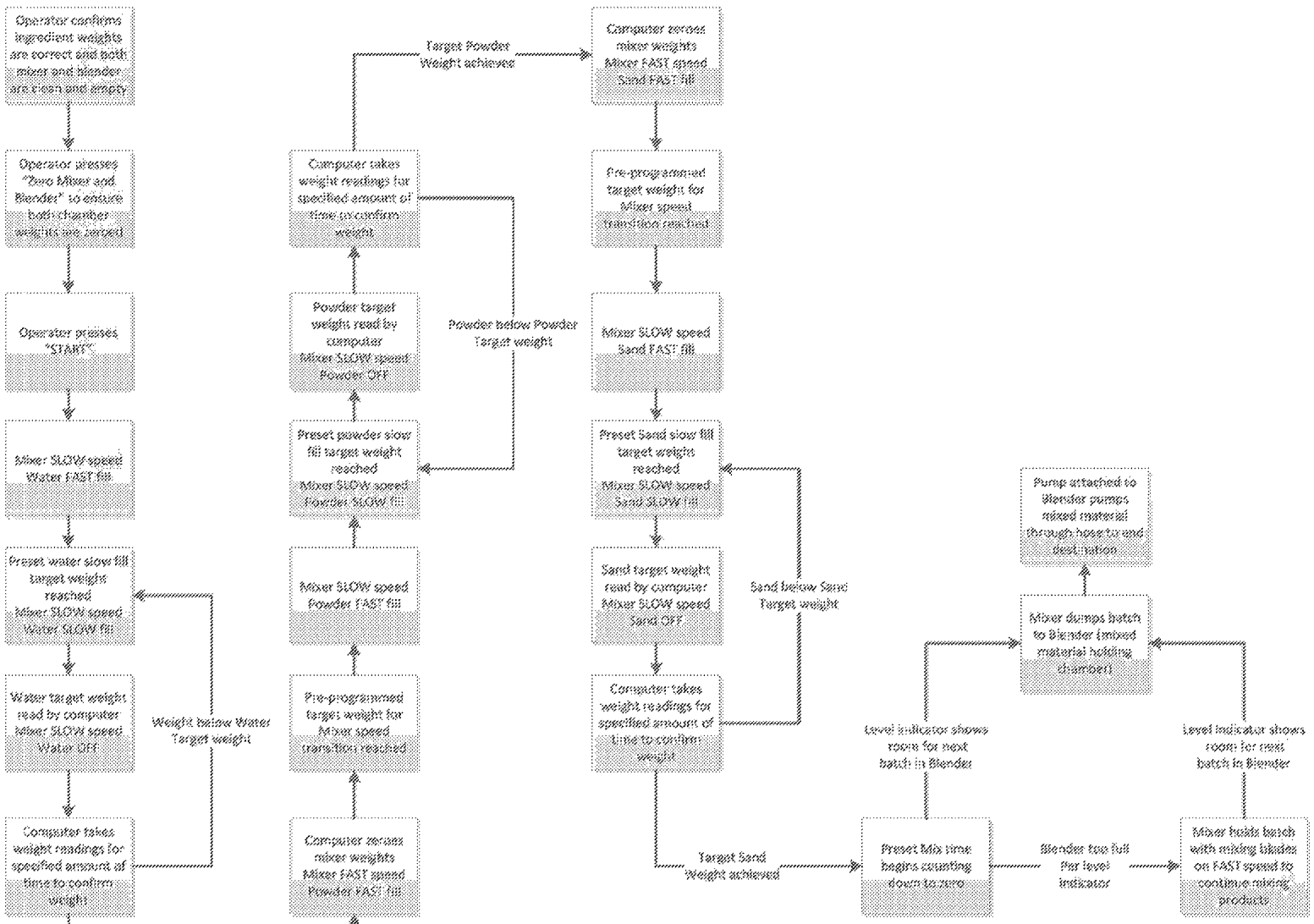
FIG. 12 depicts a flow chart of an exemplary run to make a batch of a cementitious slurry, showing in particular the flow of water using variable speed control, the flow of binder into the mixing chamber and the flow of sand into the mixing chamber.

Referring to FIG. 12, each of the steps above describing the production of a batch of slurry is set forth in a system flowchart.

The operating system 301 stores all information regarding the batch made, including the weight of each ingredient and mixing time in permanent storage. Stored data is maintained in the operating system 301 or can be transmitted or downloaded as needed. For example, and without limitation, a record of each batch for a project can be saved to removable storage. Critically, given the correspondence between ingredients ratios, mixing times and strength or other qualities of the poured slurry, the downloaded information creates a permanent record of the product characteristics of the batches. In the event a problem arises with the as-poured product, the data constitute a permanent quality assurance record suitable to support a warranty on the batches produced.

Also, a remote control can be used to remotely transmit a signal to the progressive cavity pump to stop the pump in the middle or end of an application and/or installation of a batch of slurry.

In addition to providing information about an individual batch, the data storage capabilities of the operating system allow management oversight at each project worksite. In addition to details of each batch of slurry produced during the workday, extractable and/or storable data includes the times during the day during which the apparatus was used, notification if the system was down or unused for any amount of time during a work day, when each batch was completed during the work day, the total amount of each ingredient, in pounds, bags, gallons or otherwise, used during a day. Other operation data obtained, stored and transmitted can include information concerning power consumption of the apparatus, such as the RPM of the engine providing power to the apparatus or the total amount of product produced by the apparatus each day.

By the invention, full control of all aspects of slurry production is established and maintained. Further, by the invention, a permanent, distributable quality assurance record of all production parameters is created and maintained.

What is claimed is:

1. An apparatus for producing a cementitious slurry at a remote work site from a plurality of ingredients comprising:

a platform;

at least one storage container for ingredients of a cementitious slurry supported by said platform;

a mixing chamber suitable for receiving an ingredient from the storage container, said mixing chamber having at least three feet;

a strain gauge load cell positioned between each of said feet of said mixing chamber and said platform, each strain gauge load cell is configured to communicate weight data and said strain gauge load cells are suitable for weighing the amount of each individual ingredient delivered to the mixing chamber in real time;

at least one conveyor suitable to convey cementitious slurry ingredients from the storage container to the mixing chamber;

a water tank supported by said platform;

a pump within said water tank;

a hose having a first end attached to said pump provides fluid communication between said water tank and said mixing chamber;

a nozzle attached to a second end of said hose conveys water into said mixing chamber;

at least one valve carried by said hose, said valve located between said pump and said nozzle; and, an operating system configured to receive weight data from each of said strain gauge load cells and to cause, control and monitor the rate of conveyance of the ingredients from the storage container into the mixing chamber and to end the conveyance of the ingredients from the storage container by accurately monitoring the weight of the ingredients in the mixing chamber as reported by said strain gauge load cells to said operating system, wherein said operating system is configured to monitor the rate of conveyance of water from the water tank into the mixing chamber and the weight of the water in the mixing chamber as reported by the strain gauge load cell and said operating system is also configured to account for the weight of water emitted from the nozzle but not yet in the mixing chamber.

2. The apparatus of claim 1, further comprising:

a holding chamber, said holding chamber in fluid communication with said mixing chamber;

a holding chamber scale, said holding chamber scale configured to communicate weight data to said operating system; and, a pump located in said holding chamber, said pump controlled by said operating system.

3. The apparatus of claim 2, wherein said pump is a progressive cavity pump and said valve is a hydraulic valve.

4. The apparatus of claim 1, wherein each strain gauge load cell affixes said mixing chamber to said platform.

5. The apparatus of claim 1, wherein the mixing chamber further comprises mixing blades.

6. The apparatus of claim 1, further comprising the operating system configured to control the removal of a specific amount of a mixed batch such that a known amount of the mixed batch is retained in the mixing chamber.

7. An apparatus for producing a cementitious slurry at a remote work site from a plurality of ingredients comprising:

a platform;

a plurality of storage containers for ingredients of a cementitious slurry supported by said platform;

a mixing chamber suitable for receiving an ingredient from each storage container, said mixing chamber having at least three feet;

a strain gauge load cell positioned between each of said feet of said mixing chamber and said platform, each strain gauge load cell is configured to communicate weight data and said strain gauge load cells are suitable for weighing the amount of each individual ingredient delivered to the mixing chamber in real time;

a plurality of conveyors suitable to convey cementitious slurry ingredients from each of the plurality of storage containers to the mixing chamber;

a water tank supported by said platform;

a pump within said water tank;

a hose having a first end attached to said pump provides fluid communication between said water tank and said mixing chamber;

a nozzle attached to a second end of said hose conveys water into said mixing chamber;

at least one valve carried by said hose, said valve located between said pump and said nozzle; and, an operating system configured to receive weight data from each of said strain gauge load cells and to cause, control and monitor the rate of conveyance of individual ingredients from each of the plurality of storage containers into the mixing chamber and to end the conveyance of individual ingredients from each of the storage containers by accurately monitoring the weight of each ingredient in the mixing chamber as reported by said strain gauge load cells to said operating system, the operating system also configured to monitor the rate of conveyance of water from the water tank into the mixing chamber and the weight of the water in the mixing chamber as reported by the strain gauge load cell and said operating system is also configured to account for the weight of water emitted from the nozzle but not yet in the mixing chamber.

8. The apparatus of claim 7, further comprising:

a holding chamber, said holding chamber in fluid communication with said mixing chamber;

a holding chamber scale, said holding chamber scale configured to communicate weight data to said operating system; and, a pump located in said holding chamber, said pump controlled by said operating system.

9. The apparatus of claim 8, wherein said pump is a progressive cavity pump and said valve is a hydraulic valve.

10. The apparatus of claim 7, wherein each strain gauge load cell affixes said mixing chamber to said platform.

11. The apparatus of claim 7, wherein the mixing chamber further comprises mixing blades.

12. The apparatus of claim 8, further comprising the operating system configured to control the removal of a specific amount of a mixed batch such that a known amount of the mixed batch is retained in the mixing chamber.

13. An apparatus for producing a cementitious slurry at a remote work site from a plurality of ingredients comprising:

a platform;

a plurality of storage containers for ingredients of a cementitious slurry supported by said platform;

a mixing chamber suitable for receiving an ingredient from each storage container, said mixing chamber having four feet;

a strain gauge load cell positioned between each of said feet of said mixing chamber and said platform, each strain gauge load cell is configured to communicate weight data and said strain gauge load cells are suitable for weighing the amount of each individual ingredient delivered to the mixing chamber in real time;

a plurality of conveyors suitable to convey cementitious slurry ingredients from each of the plurality of storage containers to the mixing chamber;

a water tank supported by said platform;

a pump within said water tank;

a hose having a first end attached to said pump provides fluid communication between said water tank and said mixing chamber;

a nozzle attached to a second end of said hose conveys water into said mixing chamber;

at least one valve carried by said hose, said valve located between said pump and said nozzle; and, an operating system configured to receive weight data from each of said strain gauge load cells and to cause, control and monitor the rate of conveyance of individual ingredients from each of the plurality of storage containers into the mixing chamber and to end the conveyance of individual ingredients from each of the storage containers by accurately monitoring the weight of each ingredient in the mixing chamber as reported by said strain gauge load cells to said operating system, the operating system also configured to monitor the rate of conveyance of water from the water tank into the mixing chamber and the weight of the water in the mixing chamber as reported by the strain gauge load cell and said operating system is also configured to account for the weight of water emitted from the nozzle but not yet in the mixing chamber.

14. The apparatus of claim 13, further comprising:

a holding chamber, said holding chamber in fluid communication with said mixing chamber;

a holding chamber scale, said holding chamber scale configured to communicate weight data to said operating system; and, a holding chamber pump located in said holding chamber, said holding chamber pump controlled by said operating system.

15. The apparatus of claim 14, wherein said holding chamber pump is a progressive cavity pump and said valve is a hydraulic valve.

16. The apparatus of claim 13, wherein each strain gauge load cell affixes said mixing chamber to said platform.

17. The apparatus of claim 13, wherein the mixing chamber further comprises mixing blades.

18. The apparatus of claim 13, further comprising the operating system configured to control the removal of a specific amount of a mixed batch such that a known amount of the mixed batch is retained in the mixing chamber.

19. An apparatus for producing a cementitious slurry at a remote work site from a plurality of ingredients comprising:

a platform;

a plurality of storage containers for ingredients of a cementitious slurry supported by said platform;

a mixing chamber suitable to receive an ingredient from each storage container, said mixing chamber having at least three feet;

a strain gauge load cell positioned between each of said feet of said mixing chamber and said platform, each strain gauge load cell affixes said mixing chamber to said platform, each strain gauge load cell is configured to communicate weight data and said strain gauge load cells are suitable for weighing the amount of each individual ingredient delivered to the mixing chamber in real time;

a plurality of conveyors suitable to convey cementitious slurry ingredients from each of the plurality of storage containers to the mixing chamber;

a water tank supported by said platform;

a pump within said water tank;

a hose having a first end attached to said pump provides fluid communication between said water tank and said mixing chamber;

a nozzle attached to a second end of said hose conveys water into said mixing chamber;

at least one valve carried by said hose, said valve located between said pump and said nozzle; and, an operating system configured to receive weight data from each of said strain gauge load cells and to cause, control and monitor the rate of conveyance of individual ingredients from each of the plurality of storage containers and water tank into the mixing chamber and to end the conveyance of individual ingredients from each of the storage containers and water tank by accurately monitoring the weight of each ingredient in the mixing chamber as reported by said strain gauge load cells to said operating system and said operating system also configured to account for the weight of water emitted from said nozzle but not yet in said mixing chamber.

20. The apparatus of claim 19, further comprising:

a holding chamber, said holding chamber in fluid communication with said mixing chamber;

a holding chamber scale, said holding chamber scale configured to communicate weight data to said operating system; and, a progressive cavity pump located in said holding chamber, said progressive cavity pump controlled by said operating system.

21. The apparatus of claim 19, further comprising the operating system configured to control the removal of a specific amount of a mixed batch such that a known amount of the mixed batch is retained in the mixing chamber.

* * * * *